US007712191B2

(12) United States Patent
Huang

(10) Patent No.: US 7,712,191 B2
(45) Date of Patent: May 11, 2010

(54) SECURE FASTENER FOR BELTS

(76) Inventor: Chi-San Huang, No. 2, Lane 167, Sec. 3, Chin Ma Rd., Changhua Hsien (TW)

( * ) Notice: Subject to any disclaimer, the term of this patent is extended or adjusted under 35 U.S.C. 154(b) by 163 days.

(21) Appl. No.: 12/038,268

(22) Filed: Feb. 27, 2008

(65) Prior Publication Data

US 2008/0141507 A1 Jun. 19, 2008

Related U.S. Application Data

(63) Continuation-in-part of application No. 11/307,695, filed on Feb. 17, 2006, now abandoned.

(51) Int. Cl.
*B25B 25/00* (2006.01)

(52) U.S. Cl. ..... 24/68 CD; 24/170; 24/171

(58) Field of Classification Search ..... 24/68 CD, 24/170, 191, 193, 171, 194, 196, 70 ST, 69 ST, 24/69 CT, 71 ST, 71 TD, 68 E
See application file for complete search history.

(56) References Cited

U.S. PATENT DOCUMENTS

| | | | | |
|---|---|---|---|---|
| 4,395,796 | A | 8/1983 | Akaura et al. | 24/68 CD |
| 4,451,956 | A | 6/1984 | Kawahara | 24/68 CD |
| 4,809,953 | A | 3/1989 | Kurita et al. | 254/250 |
| 2004/0128802 | A1 | 7/2004 | Templeton | 24/68 CD |

*Primary Examiner*—James R Brittain
(74) *Attorney, Agent, or Firm*—Alan Kamrath; Kamrath & Associates PA

(57) ABSTRACT

A secure fastener includes a fastening device and a security device. The fastening device includes a base, a handle pivotally installed on the base between a slackening position and a fastening position and a latch movably installed on the handle for engagement with the base in the fastening position. A first crossbar is installed on the base so that a first belt can be attached to the first crossbar. Second and third crossbars are installed on the handle so that a second belt can be directed past the third crossbar, wound around the second crossbar and directed past the third crossbar again. The security device is installed on the base and moveably urged by the handle so that the security device can be moved to push the second belt against the third crossbar in the fastening position.

13 Claims, 12 Drawing Sheets

SECURE FASTENER FOR BELTS

CROSS REFERENCE

The present application is a continuation-in-part application of U.S. patent application Ser. No. 11/307,695, filed on Feb. 17, 2006, abandoned, of which the entire disclosure is incorporated herein.

BACKGROUND OF INVENTION

1. Field of Invention

The present invention relates to a secure fastener for belts.

2. Related Prior Art

Referring to FIGS. 1 and 2, there is shown a conventional fastener for belts. The fastener includes a base 1 that includes a first crossbar 4 installed adjacent to an end thereof and a handle 2 pivotally installed thereto. The first crossbar 4 has a first belt 5 that is formed with a loop around The first crossbar 4 so that the first belt 5 is secured to the first crossbar 4. The handle 2 has a latch 3 movably installed adjacent to an end thereof, a second crossbar 6 and a third crossbar 7. A second belt 8 is directed past the third crossbar 7, wound around the second crossbar 6 and directed past the third crossbar 7 again. As seen in FIG. 1, when the fastener is in an untightened condition, the belts 5 and 8 are tensioned mildly. As seen in FIG. 2, when the fastener is in a tightened condition to fasten the belts 5 and 8 and when the handle 2 is pivoted, the latch 3 can be moved to engage with hooks 9 formed on the base 1, thereby fastening the belts 5 and 8 against the associated crossbar. However, a problem with such fastener is that there must be enough friction between the second belt 8 and the crossbars 6 and 7 for ensuring normal operation. Particularly, if a user intends to exert tension on the belts 5 and 8 larger than the friction, the second belt 8 will slip. Hence, The user cannot exert the intended tension on the belts 5 and 8.

The present invention is therefore intended to obviate or at least alleviate the problems encountered in the prior art.

SUMMARY OF INVENTION

Accordingly, the object is achieved by providing a secure fastener that includes a fastening device and a security device. The fastening device includes a base, a handle pivotally installed on the base between a slackening position and a fastening position and a latch movably installed on the handle for engagement with the base in the fastening position. A first crossbar is installed on the base so that a first belt can be attached to the first crossbar. Second and third crossbars are installed on the handle so that a second belt can be directed past the third crossbar, wound around the second crossbar and directed past the third crossbar again. The security device is installed on the base and moveably urged by the handle so that the security device can be moved to push the second belt against the third crossbar in the fastening position.

In another embodiment, the security device incorporated in the first embodiment takes the form of a leaf spring and defines a body having a face which partially includes a plurality of teeth. The body can be moveably urged by the handle such that the teeth can push the second belt against the third crossbar in the fastening position.

The primary advantage of the secure fastener according to the present invention is to provide enough friction on the second belt so that the second belt does not slip.

Other advantages and features of the present invention will become apparent from the following description referring to the drawings.

BRIEF DESCRIPTION OF DRAWINGS

The present invention wilt be described through detailed illustration of the preferred embodiments referring to the drawings, in which.

DETAILED DESCRIPTION OF PREFERRED EMBODIMENT

Figure 1:
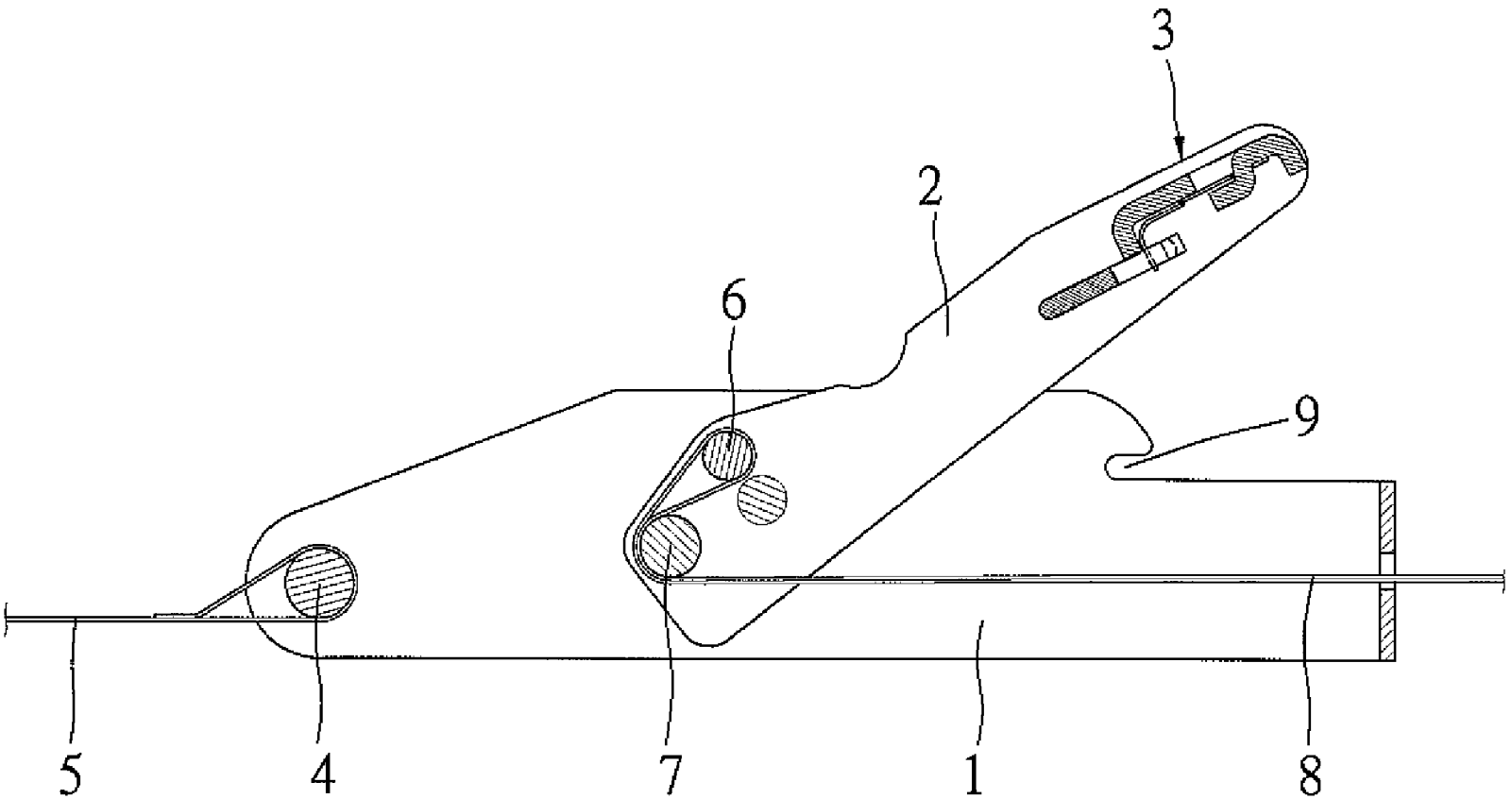
Fig. 1 PRIOR ART
FIG. 1 is a cross-sectional view of a conventional fastener for belts.
Figure 2:
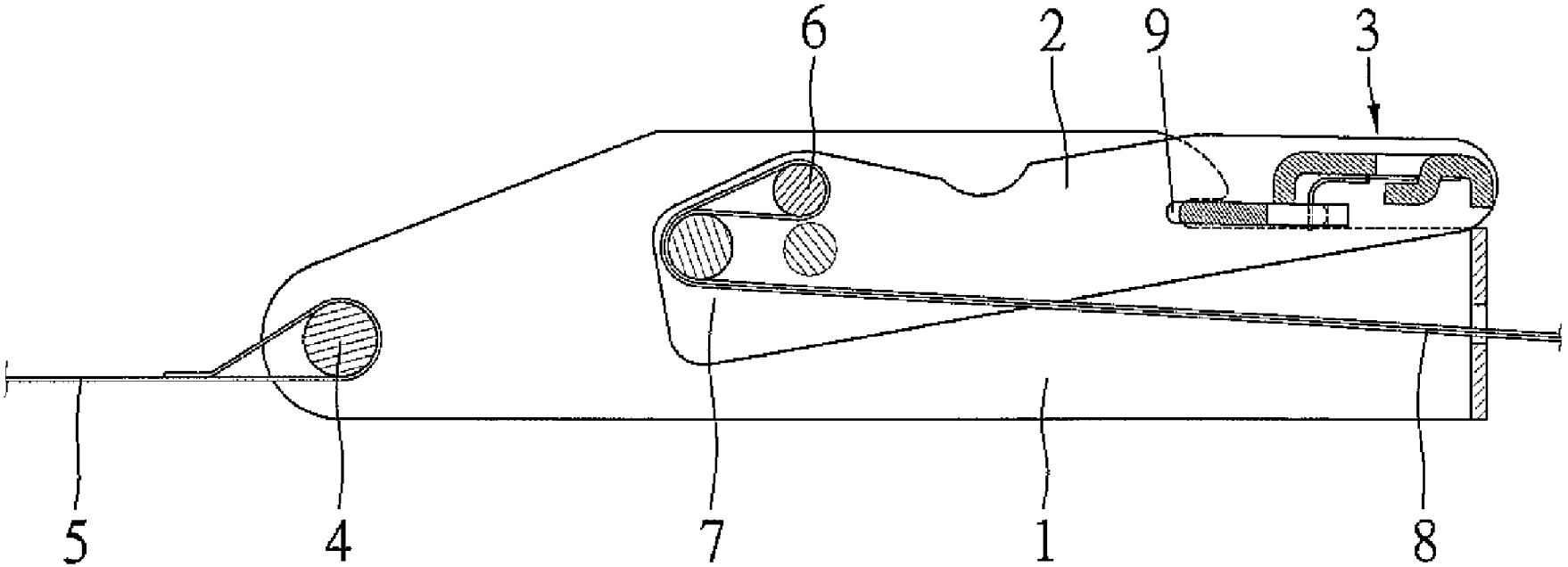
Fig. 2 PRIOR ART
FIG. 2 is a cross-sectional view of the conventional fastener of FIG. 1 in another position.
Figure 3:
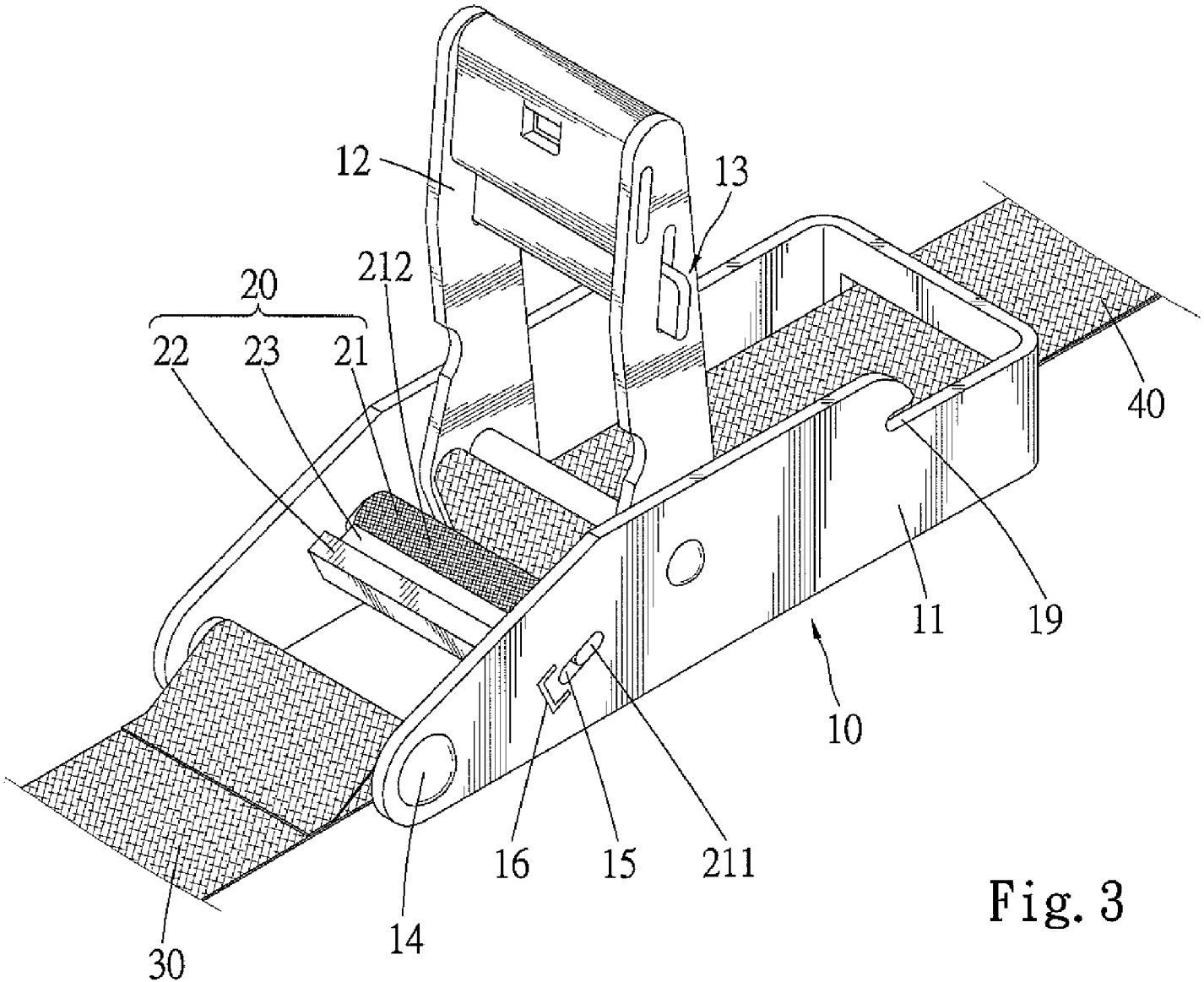
FIG. 3 is a perspective view of a secure fastener for belts according to a first embodiment of the present invention.
Figure 4:
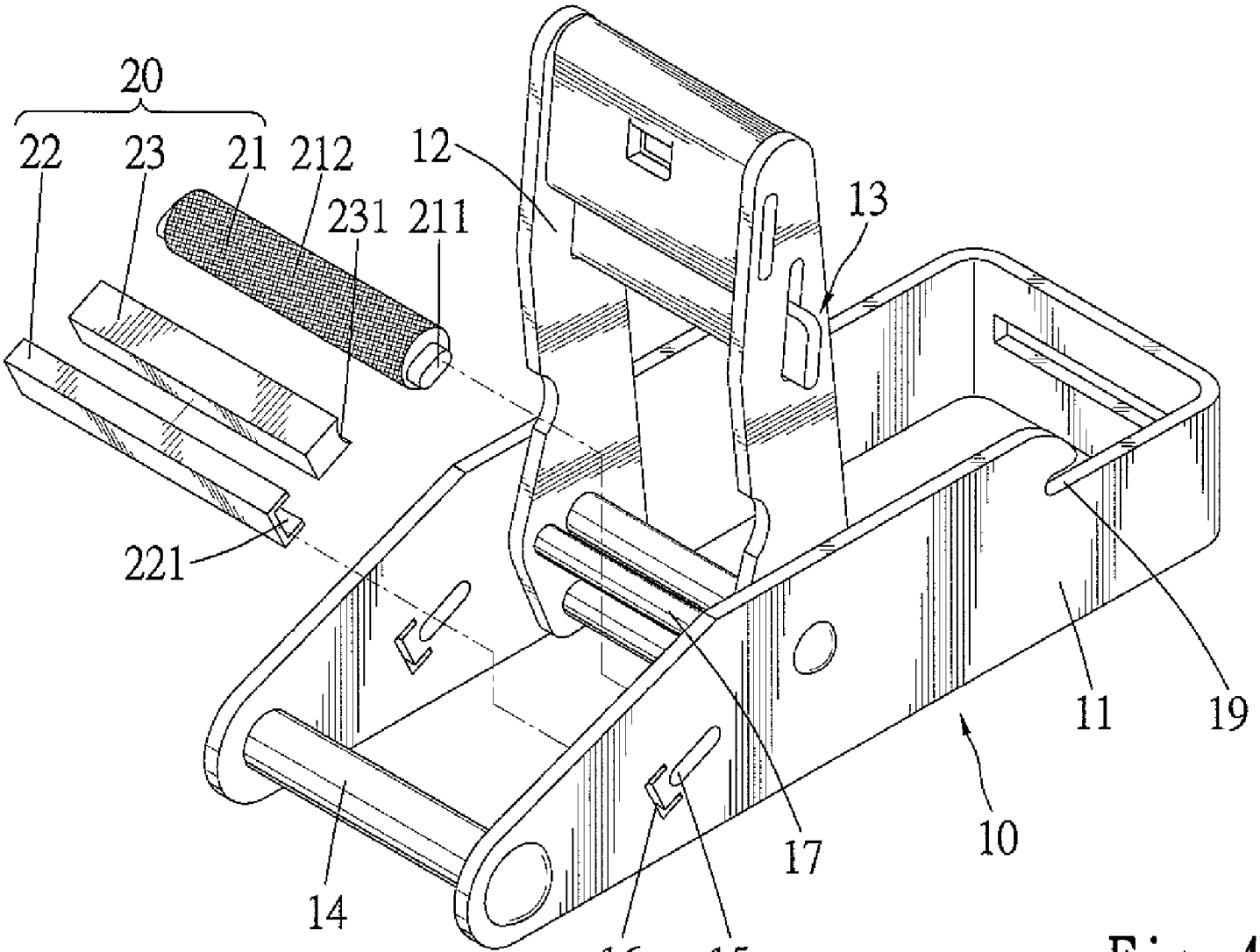
FIG. 4 is an exploded perspective view of the secure fastener of FIG. 3.

FIGS. 3-7 illustrate a secure fastener for belts according to a first embodiment of the present invention. The secure fastener includes a fastening device 10 and a security device 20. The fastening device 10 is similar to the conventional fastener discussed in the RELATED PRIOR ART except several features adapted for incorporating to the security device 20.

The fastening device 10 includes a base 11, a first crossbar 14 installed on the base 11, a handle 12 pivotally installed on the base 11 between a slackening position and a tight fastening position, a latch 13 movably installed on the handle 12 for engagement with two hooks 19 on the base 11 in the tight fastening position, a second crossbar 17 installed on the handle 12 and a third crossbar 18 (FIGS. 5 through 7) installed on the handle 12.

The base 11 includes two spaced lateral members each formed with a first slot 15 and a second slot 16 on the wall section thereof. In this embodiment, the first slot 15 is of rectilinear shape, and the second slot 16 is U-shaped. The first crossbar 14 has a length at least equal to the distance of the lateral members. Furthermore, a hook 19 is defined on and integrally formed with the related one of the lateral members of the base 11. The hook 19 defines a slotted portion. In addition, the hook 19 is co-planar with the related one of the lateral members.

The handle 12 also includes two spaced lateral members and the first, second, and third crossbars 14, 17 and 18 each has a length at least equal to the distance of the lateral members of the handle 12. A first belt 30 is formed with a loop around the first crossbar 14 so that the first belt 30 is secured to the first crossbar 14. A second belt 40 is directed past the third crossbar 18, wound around the second crossbar 17 and directed past the third crossbar 18 again.

The security device 20 includes a pressing element 21, a supporting element 22 and an elastic element 23. The pressing element 21 includes a shaft 212 having a length orthogonal to the lateral members of the base 11 and a rough peripheral surface disposed along the length thereof. The pressing element 21 also includes two fins 211 extending in the same orientation of the length of the shaft 212 at two ends thereof respectively. The fins 211 are movably engaged in the first slots 15 respectively. The supporting element 22 includes a length orthogonal to the lateral members of the base 11 and defines a cavity 221 extending along the length thereof. The supporting element 22 also has an end cross section that is complemently engagable in the second slot 16. In this embodiment, the supporting element 22 includes two ends engaged in the second slots 16 respectively. The elastic element 23 defines a side supported by the bottom wall of the cavity 221 of the supporting element 22 and a concave side 231 for supporting the shaft 212 of the pressing element 21 lengthwise.

Figure 5:
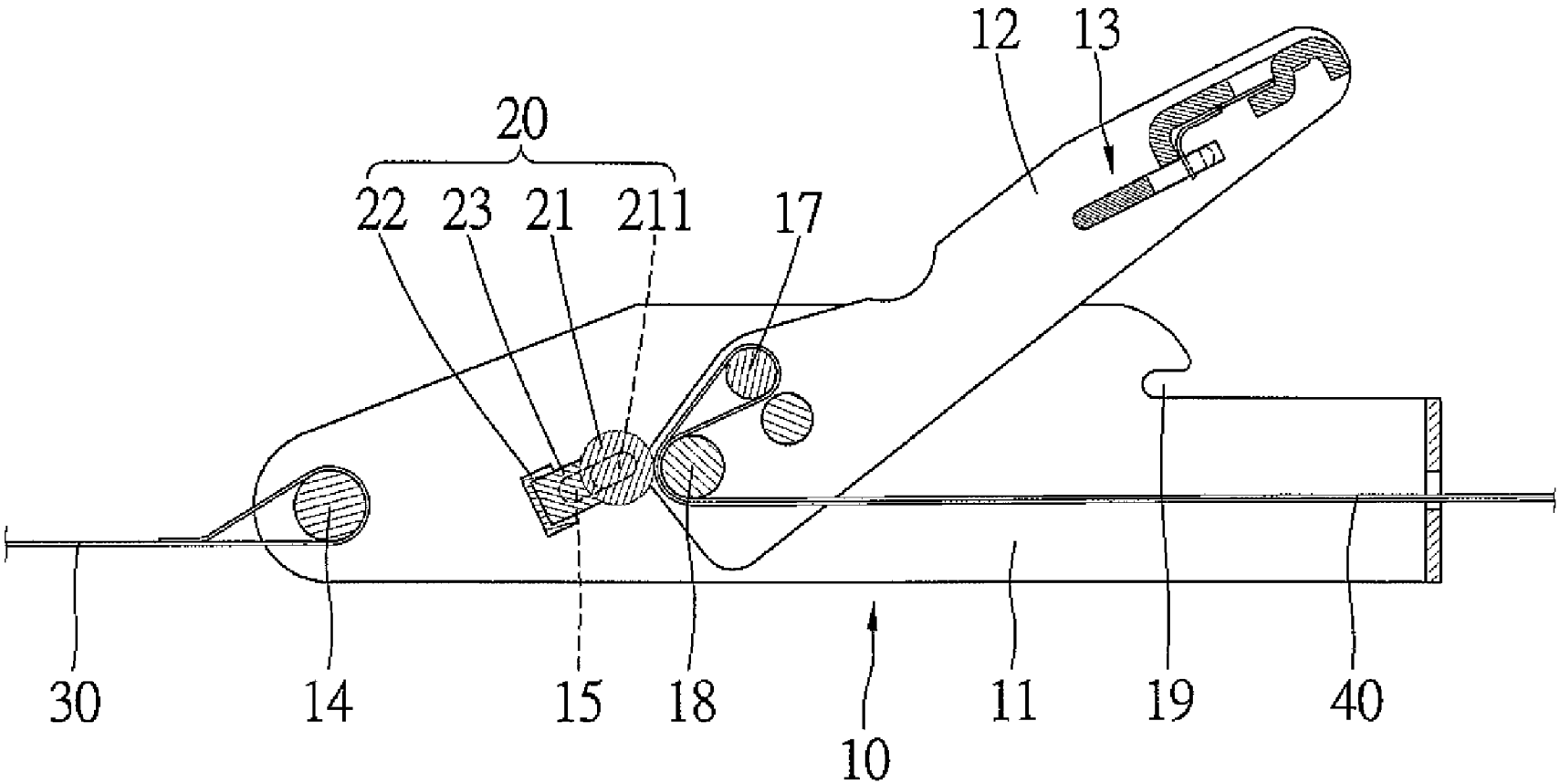
FIG. 5 is a cross-sectional view of the secure fastener of FIG. 3.

As seen in FIG. 5, the handle 12 is pivoted toward the base 11 to a position for mildly tensioning the belts 30 and 40. The pressing element 21 and the third crossbar 18 together form a pinch for the second belt 40. Now, the pinch is idle. Moreover, the peripheral surface of the shaft 212 provides for sufficient friction for precluding slippage of the belts 30 and 40.

Figure 6:
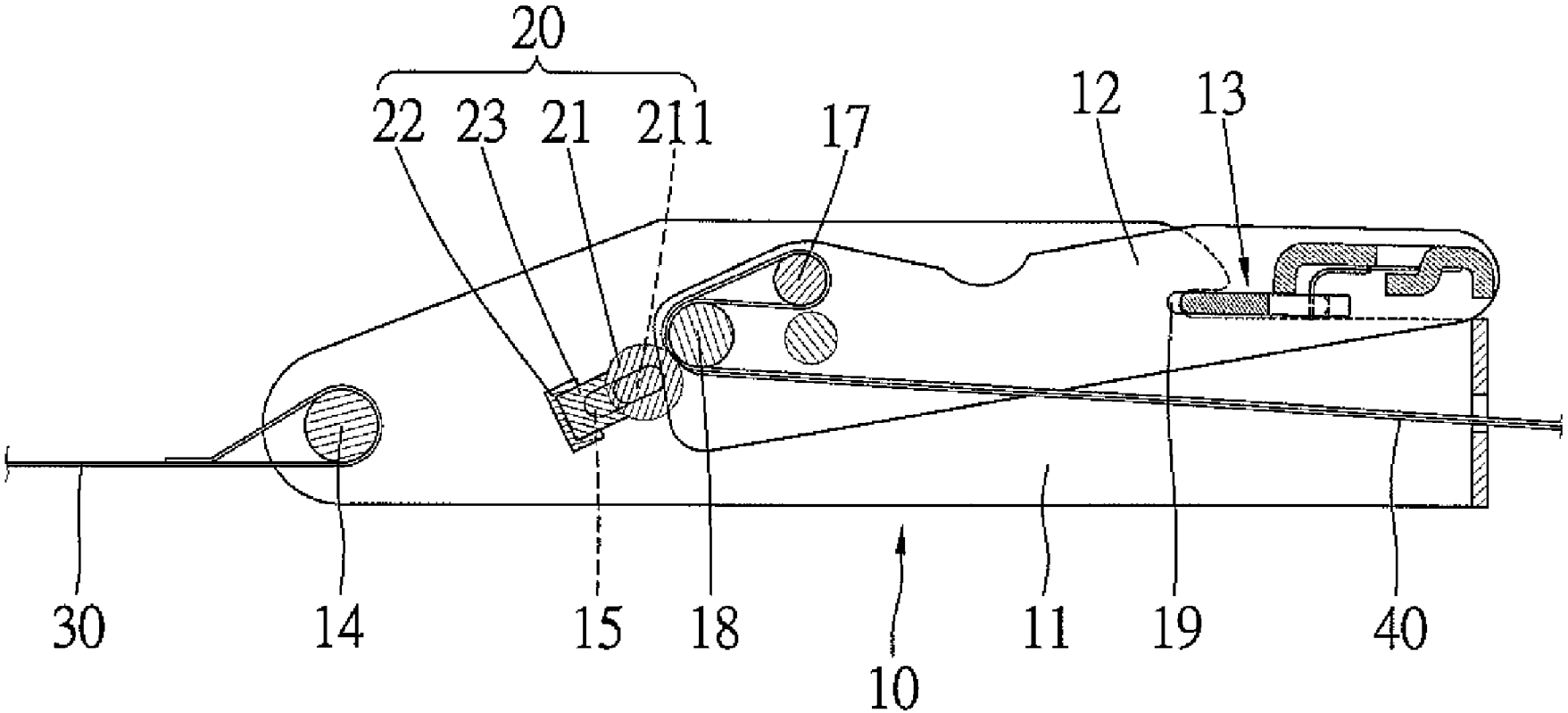
FIG. 6 is a cross-sectional view of the secure fastener of FIG. 3 in another position.

As seen in FIG. 6, the handle 12 is pivoted toward the base 11 to a position for tightly fastening the belts 30 and 40, and the latch 13 is moved to a position to be supported by the slotted portion of each hook 19. Furthermore, the crossbars 17 and 18 are correspondingly moved to new locations relative to the security device 20 due to the position change of the handle 12, and the pressing element 21 is urged by the elastic element 23 to incorporate to the third crossbar 18 to form a pinch.

Figure 7:
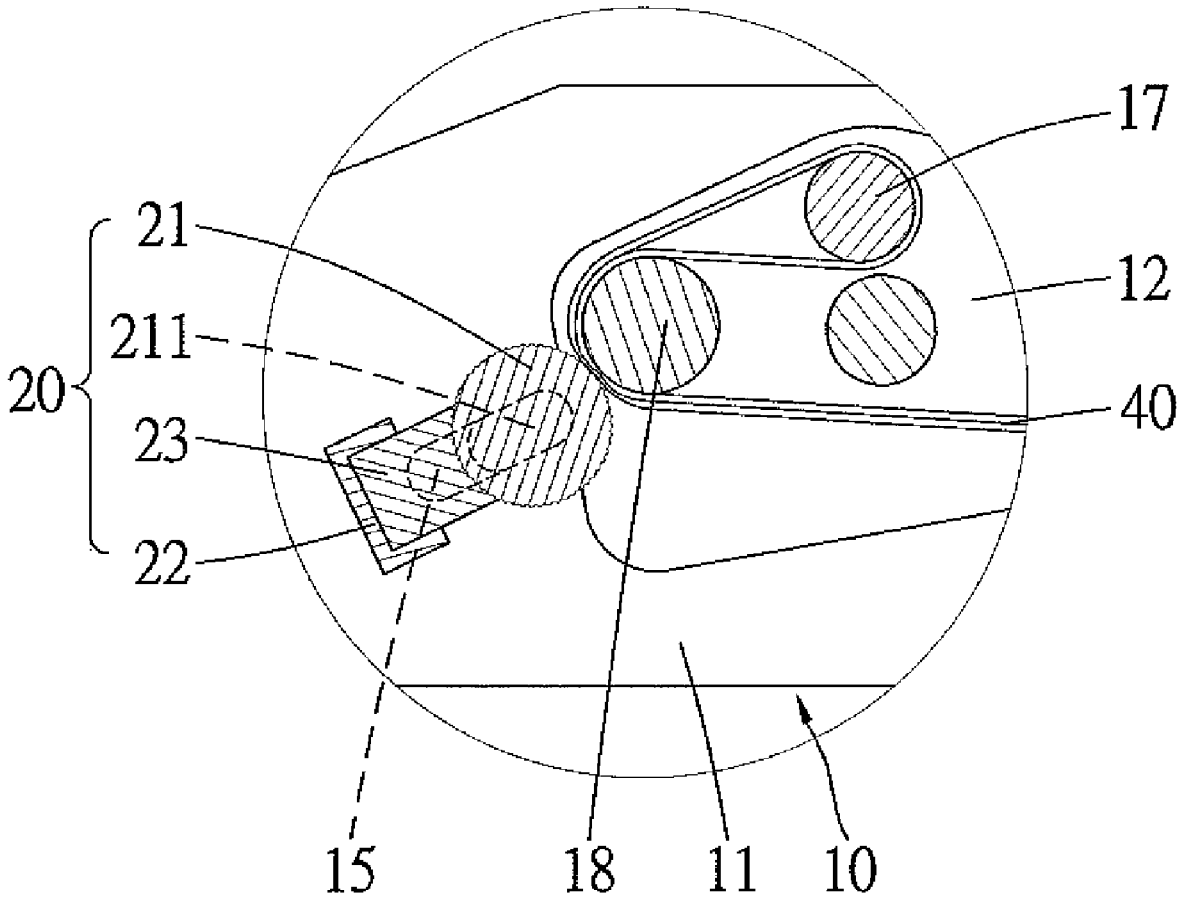
FIG. 7 is an enlarged, partial cross-sectional view of the secure fastener of FIG. 6.

FIG. 7 is a partial, enlarged view of FIG. 6, and it can be seen that the pinch pinches the second belt 40. The elastic element 23 pushes the pressing element 21 firmly against the second belt 40. The friction between the second belt 40 and the crossbars 17 and 18 and the friction between the second belt 40 and the pinch ensures normal operation.

Figure 8:
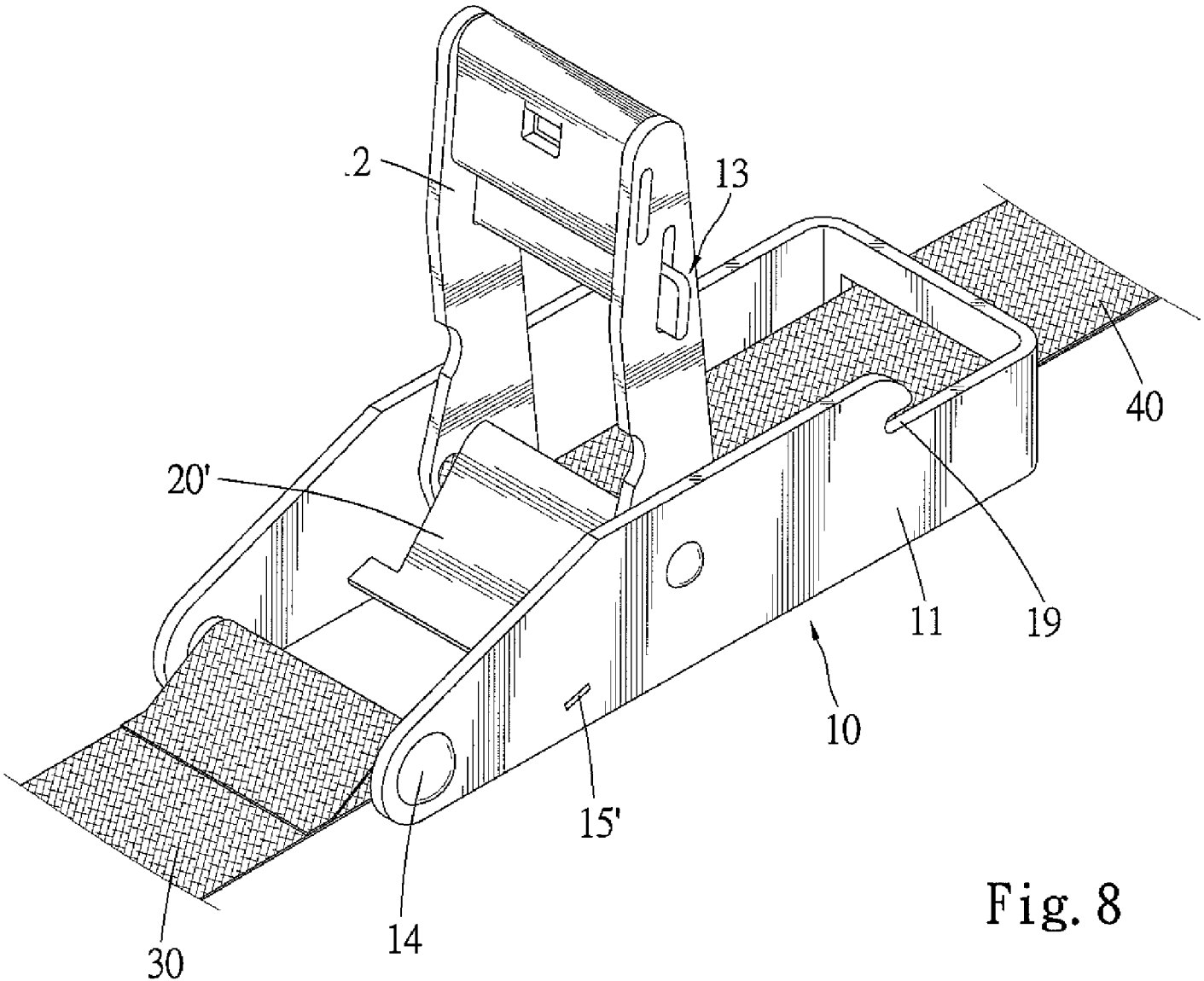
FIG. 8 is a perspective view of a secure fastener for belts according to a second embodiment of the present invention.
Figure 9:
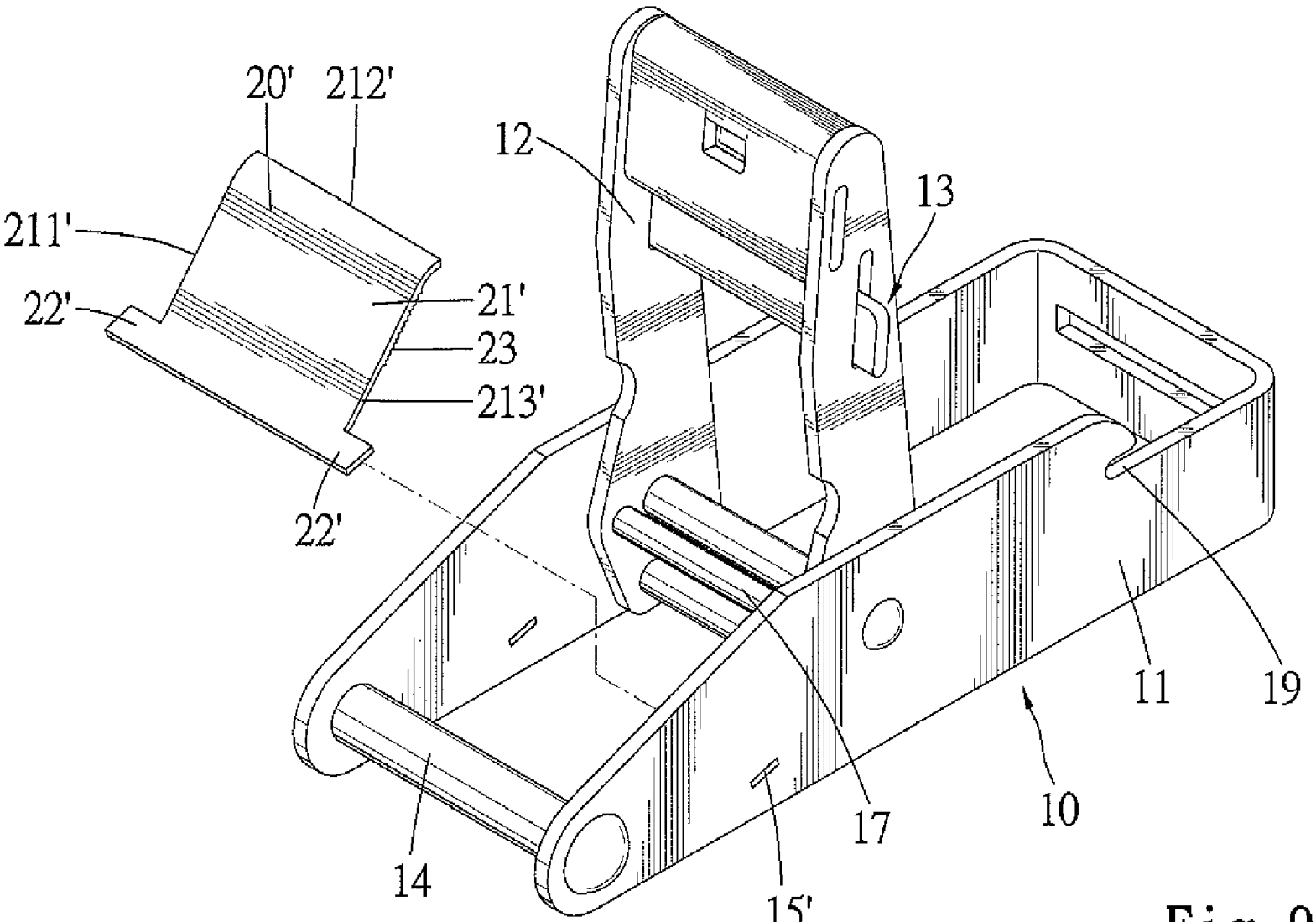
FIG. 9 is an exploded perspective view of the secure fastener of FIG. 8.

FIGS. 8 and 9 illustrate a second embodiment of a secure fastener according to the present invention. In the second embodiment, the first and second slots 15 and 16 on each of the lateral members of the base 11 are omitted, and, instead, each lateral member includes a slot 15' on the wall section thereof. Furthermore, the security device 20 incorporated in the first embodiment is replaced by the security device 20'. The security device 20' takes the form of a leaf spring and defines a body 21' on which are formed two extensions 22'. The two extensions 22' are inserted in two slots 15' of the base 10 respectively. In this embodiment, the body 21' and the extensions 22' are angled with each other.

The body 21' of the security device 20' further defines two opposite faces, and one of the faces partially includes a plurality of teeth 23'. Optionally but preferably, the teeth 23' extend from the left peripheral side 211' to the right peripheral side 213' of the body 21' of the security device 20' in order to provide for greater frictional contact with the third crossbar 18. In this embodiment the right and left peripheral sides 211' and 213' are opposite to each other. In addition, a top peripheral side 212' extending transversely between left and right peripheral sides 211' and 213' and the top peripheral side 212' has a length at least equal or slightly smaller than the distance between the lateral members of the handle 12. It should be understood that the terms "right" "left" and "top" herein have reference only to the structure of the security device 20' shown in the drawings and are utilized only to facilitate describing the second embodiment.

Figure 10:
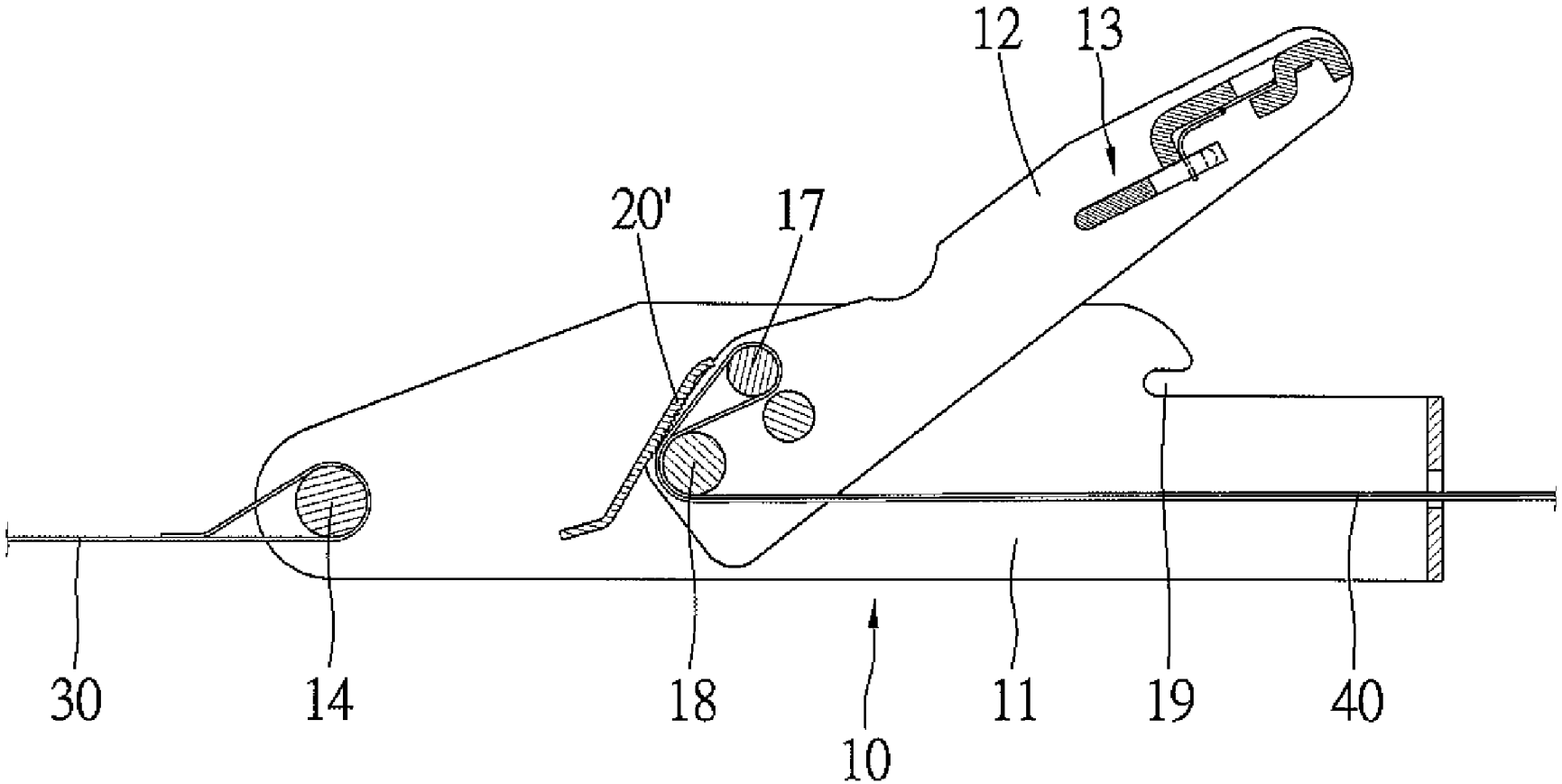
FIG. 10 is a cross-sectional view of the secure fastener of FIG. 8.

As seen in FIG. 10, the handle 12 is pivoted toward the base 11 to a position for mildly tensioning the belts 30 and 40. The security device 20' and the third crossbar 18 together form a pinch for the second belt 40. Now, the pinch is idle. Moreover, the teeth 23' of the security device 20' provide for sufficient friction for precluding slippage of the belts 30 and 40.

Figure 11:
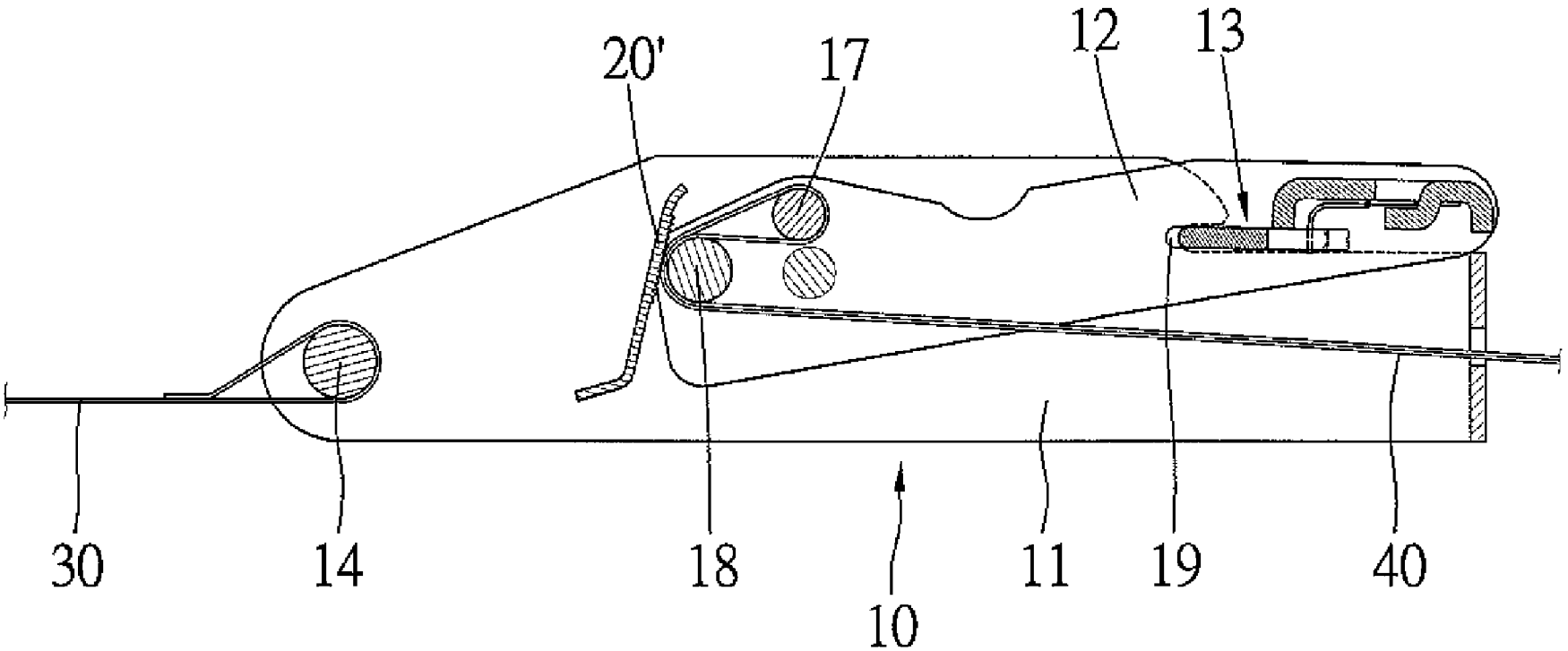
FIG. 11 is a cross-sectional view of the secure fastener of FIG. 8 in another position.

As seen in FIG. 11, the handle 12 is pivoted toward the base 11 to a position for tightly fastening the belts 30 and 40, and the latch 13 is moved to a position to be supported by the slotted portion of each hook 19. Furthermore, the crossbars 17 and 18 are correspondingly moved to new locations relative to the security device 20 due to the position change of the handle 12, and the body 21' of the security device 20' is urged to incorporate to the third crossbar 18 to form a pinch due to resilient characteristic of the security device 20'.

Figure 12:
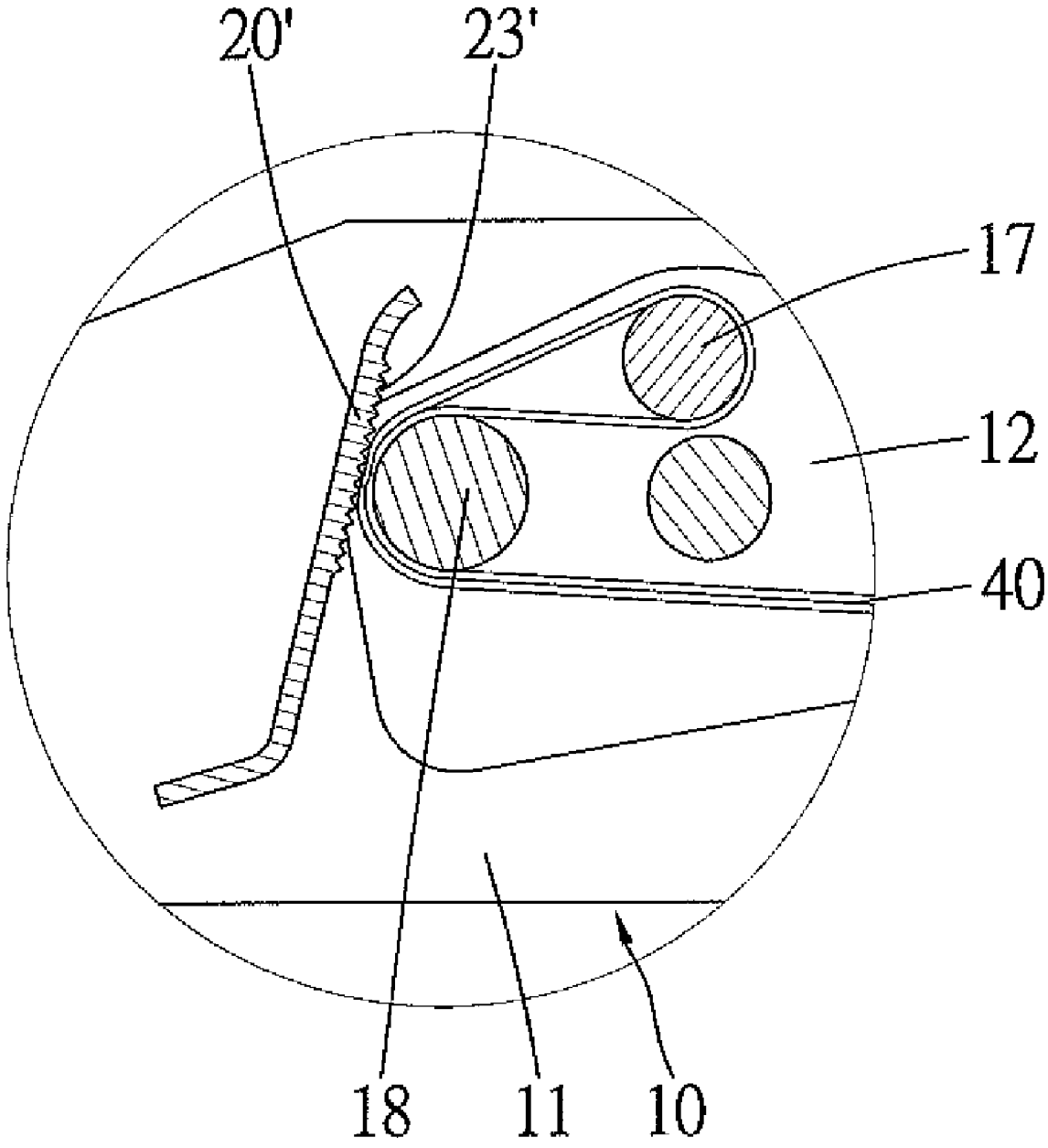
FIG. 12 is an enlarged, partial cross-sectional view of the secure fastener of FIG. 11.

FIG. 12 is a partial, enlarged view of FIG. 11, and it can be seen that the pinch pinches the second belt 40. The teeth 23' of the security device 20' are firmly against the second belt 40. The friction between the second belt 40 and the crossbars 17 and 18 and the friction between the second belt 40 and the pinch ensure normal operation.

In view of the forgoing description, the invention is advantageous in that if the thickness of the second belt 40 is changed, the elastic element 23 and the security device 20' can compensate such change in the thickness of the second belt 40 and still push the pressing clement 21 firmly against the second belt 40.

Moreover, the secure fastener of the present invention exhibits at least two advantages. Firstly, it provides enough friction on the second belt 40 so that the second belt 40 does not slip. Secondly, it compensates for change in the thickness of the second belt 40.

The present invention has been described through the illustration of the preferred embodiments. Those skilled in the art can derive variations from the preferred embodiments without departing from the scope of the present invention. Therefore, the preferred embodiments shall not limit the scope of the present invention defined in the claims.

The invention claimed is:

1. A secure fastener comprising:

a fastening device comprising a base, a handle pivotally installed on the base between a slackening position and a tight fastening position, a latch movably installed on the handle for engagement with the base in the tight fastening position, a first crossbar installed on the base, a first belt attached to the first crossbar, a second and a third crossbar installed on the handle, and a second belt directed past the third crossbar, wound around the second crossbar and directed past the third crossbar again; and a security device installed on the base and moveably urged by the handle;

wherein the security device pushes the second belt against the third crossbar for fastening the first and second belts;

wherein the security device comprises a pressing element moveably installed on the base for pushing the second belt against the third crossbar;

wherein the pressing element comprises a shaft having a rough peripheral surface;

wherein the pressing element comprises two fins extending from two ends of the shaft respectively; and wherein the base defines two slots and along which the fins are movable therein.

2. The secure fastener according to claim 1 wherein the security device defines a body moveably urged by the handle, and with the body comprising two opposite faces and one of the faces including a plurality of teeth.

3. The secure fastener according to claim 2 wherein the security device comprises two extensions extended from the body.

4. A secure fastener comprising:

a fastening device comprising a base, a handle pivotally installed on the base between a slackening position and a tight fastening position, a latch movably installed on the handle for engagement with the base in the tight fastening position, a first crossbar installed on the base, a first belt attached to the first crossbar, a second and a third crossbar installed on the handle, and a second belt directed past the third crossbar, wound around the second crossbar and directed past the third crossbar again; and a security device installed on the base and moveably urged by the handle;

wherein the security device pushes the second belt against the third crossbar for fastening the first and second belts;

wherein the security device comprises a pressing element moveably installed on the base for pushing the second belt against the third crossbar; and wherein the security device comprises an elastic element installed on the base for biasing the pressing element.

5. The secure fastener according to claim 4 wherein the security device comprises a supporting element installed on the base for supporting the elastic element.

6. The secure fastener according to claim 5 wherein the supporting element comprises a U-shaped cross-sectional configuration for receiving the elastic element.

7. The secure fastener according to claim 5 wherein the base defines two slots, wherein the supporting element has end cross sections that are complemently engagable in the two slots, and wherein the supporting element includes two ends engaged in the two slots respectively.

8. The secure fastener according to claim 4 wherein the elastic element comprises a concave side for contact with the pressing element.

9. A secure fastener comprising:

a fastening device comprising a base, a handle pivotally installed on the base between a slackening position and a tight fastening position, a latch movably installed on the handle for engagement with the base in the tight fastening position, a first crossbar installed on the base so that a first belt can be attached to the first crossbar, a second and a third crossbar installed on the handle and so that a second belt can be directed past the third crossbar, wound around the second crossbar and directed past the third crossbar again; and a security device installed on the base and moveably urged by the handle;

whereby the security device can push the second belt against the third crossbar for fastening the first and second belts;

wherein the security device comprises a pressing element moveably installed on the base for pushing the second belt against the third crossbar;

wherein the pressing element comprises two fins; and wherein the base defines two slots in and along with the two fins are moveable.

10. A secure fastener comprising:

a fastening device comprising a base, a handle pivotally installed on the base between a slackening position and a tight fastening position, a latch movably installed on the handle for engagement with the base in the tight fastening position, a first crossbar installed on the base so that a first belt can be attached to the first crossbar, a second and a third crossbar installed on the handle and so that a second belt can be directed past the third crossbar, wound around the second crossbar and directed past the third crossbar again; and a security device installed on the base and moveably urged by the handle; and whereby the security device can push the second belt against the third crossbar for fastening the first and second belts;

wherein the security device comprises a pressing element moveably installed on the base for pushing the second belt against the third crossbar; and wherein the security device comprises an elastic element installed on the base for biasing the pressing element.

11. The secure fastener according to claim 10 wherein the elastic element comprises a concave side for contact with the pressing element.

12. The secure fastener according to claim 10 wherein the security device comprises a supporting element installed on the base for supporting the elastic element.

13. The secure fastener according to claim 12 wherein the supporting element comprises a U-shaped cross-sectional configuration for receiving the elastic element.

* * * * *